US008720590B2

(12) United States Patent
Guest et al.

(10) Patent No.: US 8,720,590 B2
(45) Date of Patent: May 13, 2014

(54) PERMEABLE MATERIAL COMPACTING METHOD AND APPARATUS

(75) Inventors: Randall V. Guest, Spring, TX (US); Edward J. O'Malley, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 308 days.

(21) Appl. No.: 13/204,133

(22) Filed: Aug. 5, 2011

(65) Prior Publication Data

US 2013/0032343 A1 Feb. 7, 2013

(51) Int. Cl.
*E21B 19/00* (2006.01)
*E21B 43/08* (2006.01)

(52) U.S. Cl.
USPC ..... 166/385; 166/51; 166/380; 166/276; 425/89; 425/329; 226/172

(58) Field of Classification Search
USPC ..... 166/278, 51, 380, 385, 77.3, 276; 226/170, 171, 172, 173; 425/89
See application file for complete search history.

(56) References Cited

U.S. PATENT DOCUMENTS

| | | | | |
|---|---|---|---|---|
| 1,352,493 | A | | 9/1920 | Wolffgram |
| 3,089,187 | A | | 5/1963 | Wolfe |
| 3,099,318 | A | | 7/1963 | Miller et al. |
| 3,205,289 | A | | 9/1965 | Carpenter |
| 3,371,793 | A | | 3/1968 | Fowler |
| 3,566,653 | A | | 3/1971 | Unrath |
| 3,695,076 | A | | 10/1972 | Kocks |
| 3,892,832 | A | * | 7/1975 | Schey ..... 264/109 |
| 3,933,557 | A | | 1/1976 | Pall |
| 4,214,612 | A | | 7/1980 | de Putter |
| 4,260,096 | A | | 4/1981 | Samarynov et al. |
| 4,358,064 | A | | 11/1982 | Garneau |
| 4,363,845 | A | | 12/1982 | Hartmann |
| 4,474,845 | A | | 10/1984 | Hagerman et al. |
| 4,518,340 | A | | 5/1985 | Jakobsen et al. |
| 4,545,947 | A | | 10/1985 | Bozoarth et al. |
| 4,577,481 | A | | 3/1986 | Staat |
| 4,592,782 | A | | 6/1986 | Davies |
| 4,621,999 | A | | 11/1986 | Gerhardt |
| 4,807,525 | A | | 2/1989 | de Brock |

(Continued)

FOREIGN PATENT DOCUMENTS

| | | |
|---|---|---|
| EP | 0177167 A1 | 4/1986 |
| JP | 06-047219 A | 2/1994 |

(Continued)

OTHER PUBLICATIONS

Notification of Transmittal of the International Search Report and the Written Opinion of the International Searching Authority; PCT/US2012/041239; Mailed Jan. 2, 2013; Korean Intellectual Property Office; 9 pages.

(Continued)

*Primary Examiner* — Cathleen Hutchins
(74) *Attorney, Agent, or Firm* — Cantor Colburn LLP

(57) ABSTRACT

A permeable material compacting method includes, positioning a portion of at least one elongated member within the interior of a tubular, moving a portion of the at least one elongated member through the interior of the tubular, moving a permeable material through the interior of the tubular with the portion of the at least one elongated member, and radially compacting the permeable material as the permeable material passes through the interior of the tubular.

17 Claims, 4 Drawing Sheets

(56) References Cited

U.S. PATENT DOCUMENTS

| | | | | |
|---|---|---|---|---|
| 4,816,106 | A | 3/1989 | Turris et al. | |
| 4,924,568 | A | 5/1990 | Sato et al. | |
| 4,976,915 | A | 12/1990 | Kuroki | |
| 5,032,622 | A | 7/1991 | Herrington et al. | |
| 5,049,591 | A | 9/1991 | Hayashi et al. | |
| 5,098,776 | A | 3/1992 | Kobayashi et al. | |
| 5,120,380 | A * | 6/1992 | Strachan | 156/164 |
| 5,207,960 | A | 5/1993 | Moret de Rocheprise | |
| 5,230,726 | A | 7/1993 | Smith et al. | |
| 5,242,651 | A | 9/1993 | Brayden et al. | |
| 5,324,117 | A | 6/1994 | Matsushita et al. | |
| 5,429,847 | A | 7/1995 | Ando et al. | |
| 5,501,832 | A | 3/1996 | Adams | |
| 5,503,784 | A | 4/1996 | Balk | |
| 5,520,758 | A | 5/1996 | Kelman et al. | |
| 5,533,370 | A | 7/1996 | Kuroda et al. | |
| 5,565,049 | A | 10/1996 | Simmons et al. | |
| 5,770,016 | A | 6/1998 | Greve | |
| 5,964,798 | A | 10/1999 | Imran | |
| 6,281,289 | B1 | 8/2001 | Maugans et al. | |
| 6,302,676 | B1 | 10/2001 | Kato et al. | |
| 6,321,503 | B1 | 11/2001 | Warren | |
| 6,342,283 | B1 | 1/2002 | Mozelack et al. | |
| 6,388,043 | B1 | 5/2002 | Langer et al. | |
| 6,472,449 | B1 | 10/2002 | Heinemann et al. | |
| 6,521,555 | B1 | 2/2003 | Bodaghi et al. | |
| 6,560,942 | B2 | 5/2003 | Warren et al. | |
| 6,583,194 | B2 | 6/2003 | Sendijarevic | |
| 6,769,484 | B2 * | 8/2004 | Longmore | 166/207 |
| 6,817,441 | B2 | 11/2004 | Murakami et al. | |
| 6,827,764 | B2 | 12/2004 | Springett et al. | |
| 6,935,432 | B2 | 8/2005 | Nguyen | |
| 6,983,796 | B2 | 1/2006 | Bayne et al. | |
| 6,986,855 | B1 | 1/2006 | Hood et al. | |
| 7,048,048 | B2 | 5/2006 | Nguyen et al. | |
| 7,134,501 | B2 | 11/2006 | Johnson et al. | |
| 7,155,872 | B2 | 1/2007 | Francom | |
| 7,234,518 | B2 | 6/2007 | Smith | |
| 7,552,767 | B2 | 6/2009 | Wood | |
| 7,644,773 | B2 | 1/2010 | Richard | |
| 7,677,321 | B2 | 3/2010 | Spray | |
| 7,712,529 | B2 | 5/2010 | Dusterhoft et al. | |
| 7,743,835 | B2 | 6/2010 | Willauer | |
| 7,828,055 | B2 | 11/2010 | Willauer et al. | |
| 2002/0144822 | A1 | 10/2002 | Hackworth et al. | |
| 2003/0213380 | A1 | 11/2003 | Sebastian et al. | |
| 2004/0241410 | A1 | 12/2004 | Fischer et al. | |
| 2005/0056425 | A1 | 3/2005 | Grigsby et al. | |
| 2005/0126699 | A1 | 6/2005 | Yen et al. | |
| 2005/0173130 | A1 | 8/2005 | Zamora et al. | |
| 2005/0205263 | A1 | 9/2005 | Richard | |
| 2005/0272211 | A1 | 12/2005 | Browne et al. | |
| 2006/0228963 | A1 | 10/2006 | Souther et al. | |
| 2007/0044891 | A1 | 3/2007 | Sellars et al. | |
| 2007/0211970 | A1 | 9/2007 | Nagata et al. | |
| 2008/0006413 | A1 | 1/2008 | Le Gloahec et al. | |
| 2008/0296020 | A1 | 12/2008 | Willauer | |
| 2008/0296023 | A1 | 12/2008 | Willauer | |
| 2009/0252926 | A1 | 10/2009 | Henderson et al. | |
| 2009/0301635 | A1 | 12/2009 | Corre et al. | |
| 2009/0319034 | A1 | 12/2009 | Sowinski | |
| 2010/0038076 | A1 | 2/2010 | Spray et al. | |
| 2010/0144247 | A1 | 6/2010 | Lunn et al. | |
| 2011/0178237 | A1 | 7/2011 | Ono et al. | |

FOREIGN PATENT DOCUMENTS

| | | | |
|---|---|---|---|
| JP | 6-210318 | | 8/1994 |
| JP | 6210309 | A | 8/1994 |
| JP | 3279962 | B2 | 4/2002 |
| WO | 2004099560 | A1 | 11/2004 |
| WO | 2007106429 | | 9/2007 |

OTHER PUBLICATIONS

Notification of Transmittal of the International Search Report and the Written Opinion of the International Searching Authority; PCT/US2012/048795; Mailed Feb. 14, 2013; Korean Intellectual Property Office; 10 pages.

Notification of Transmittal of the International Search Report and the Written Opinion of the International Searching Authority; PCT/US2012/048796; Mailed Feb. 8, 2013, Korean Intellectual Property Office; 6 pages.

Notification of Transmittal of the International Search Report and the Written opinion of the International Searching Authority; PCT/US2012/048798; Mailed Feb. 20, 2013, Korean Intellectual Property Office; 8 pages.

International Search Report and Written Opinion, International Application No. PCT/US2012/021274, Date of Mailing Aug. 17, 2012, Korean Intellectual Property Office, International Search report 5 pages, Written Opinion 7 pages.

J. Heiland et al., "The Role of the Annular Gap in Expandable Sand Screen Completions"; Society of Petroleum Engineers; SPE Paper No. 86463; Feb. 18-20, 2004.

Lorrie A. Krebs et al., "Pitting Resistance of Nitinol Stents Before and After Implantation"; NACE International; Paper No. 09461; Corrosion Conference and Expo Mar. 22-26, 2009.

Witold M. Sokolowski et al., "Cold hibernated elastic memor(yC HEM) self-deployable structures"; Jet Propulsion Laboratory, California Institute of Technology, Mar. 1, 1999.

SPE Distinguished Lecturer Series[online]; retrieved on Sep. 25, 2009]; retrieved from the internet at: http://www.spe.org/spe-site/spe/spe/events/dl/Ott.pdf.

C.F. Williams et al., "A New Sizing Criterion for Conformable and Nonconformable Sand Screens Based on Uniform Pore Structures"; Society of Petroleum Engineers, SPE Paper No. 98235; Feb. 15-17, 2006.

Notification of Transmittal of the International Search Report and the Written Opinion of the International Searching Authority, PCT/US2011/031768; Mailed Sep. 30, 2011; Korean Intellectual Property Office.

G. Scott Lester et al., "Field Application of a New Cleanable and Damage Tolerant Downhole Screen,"; Society of Petroleum Engineers, SPE Paper No. 30132, May 15, 1995.

Jiaxing (Jason) Ren et al., "Studying the Effect of Chemical Aging on the Properties of a Shape Memory Material", Offshore Technology Conference, Paper No. OTC 21317; May 2, 2011.

Notification of Transmittal of the International Search Report and the Written Opinion of the International Searching Authority; PCT/US2012/021273; Korean Intellectual Property Office; Mailed Sep. 26, 2012; 8 pages.

* cited by examiner

PERMEABLE MATERIAL COMPACTING METHOD AND APPARATUS

BACKGROUND

Gravel packing is a process used in the downhole industry to fill an annulus with gravel. Gravel packed by such a process is permeable to fluid while providing support to walls of a wellbore in an earth formation, for example. The support prevents erosion and other damage to the formation walls that could result if the gravel support were not present. Recent developments replace the gravel pack with permeable space conforming materials that can expand to fill an annulus after being deployed therein. Such materials, as those described in U.S. Pat. No. 7,828,055 granted to Willauer et al. on Nov. 9, 2010, in U.S. Pat. No. 5,049,591 to Kaisha on Sep. 17, 1991 and methods as described in U.S. Pat. No. 7,644,773 to Richard on Jan. 12, 2010, the entire contents of which are incorporated herein by reference, require compaction or compression prior to being deployed. Methods and systems for compacting such materials are well received in the art.

BRIEF DESCRIPTION

Disclosed herein is a permeable material compacting method. The method includes, positioning a portion of at least one elongated member within the interior of a tubular, moving a portion of the at least one elongated member through the interior of the tubular, moving a permeable material through the interior of the tubular with the portion of the at least one elongated member, and radially compacting the permeable material as the permeable material passes through the interior of the tubular.

Further disclosed herein is a permeable material compacting apparatus. The apparatus includes, a tubular having an internal surface with varying radial dimensions, and at least one elongated member that is movable through the interior of the tubular and configured to conform to the internal surface such that permeable material moved through the interior of the tubular with the at least one elongated member is compacted.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
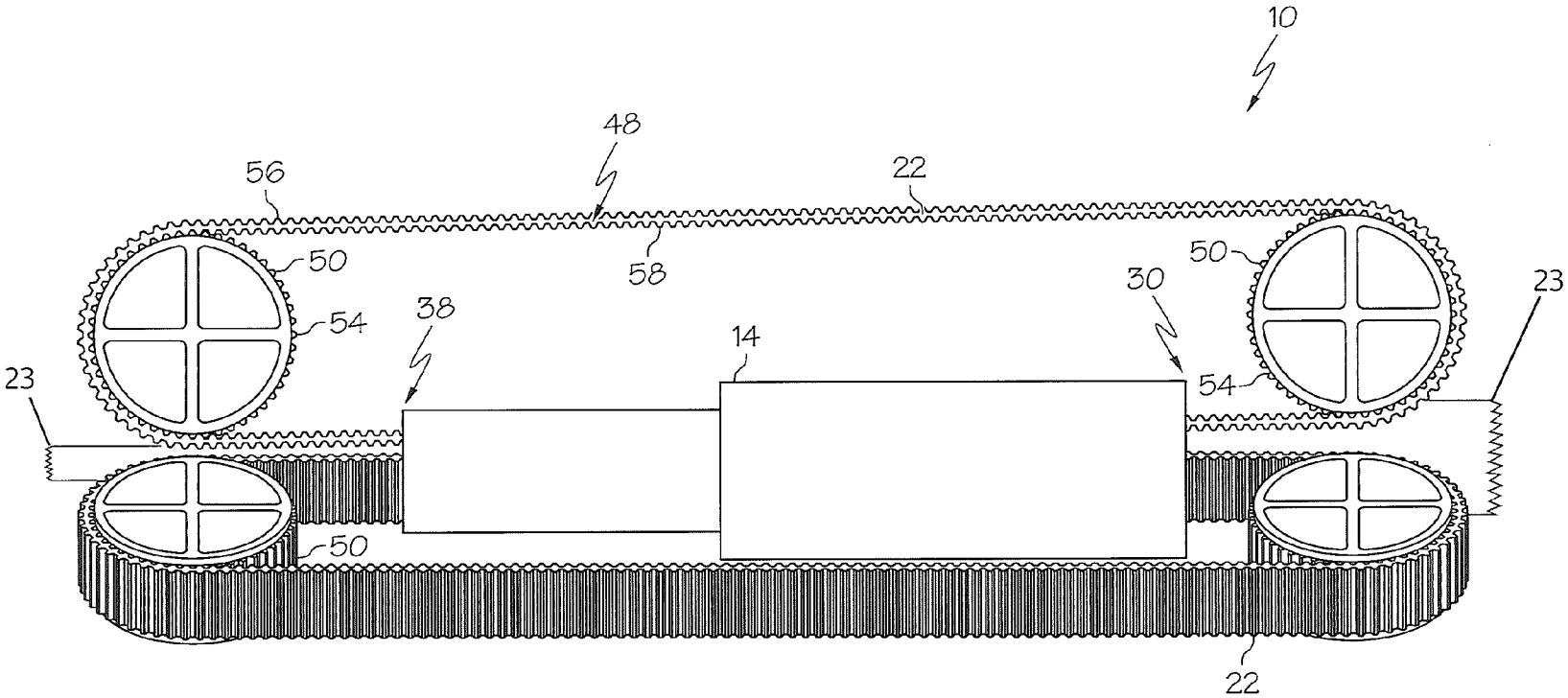
FIG. 1 depicts a partial side view of a permeable material compacting apparatus disclosed herein.
Figure 2:
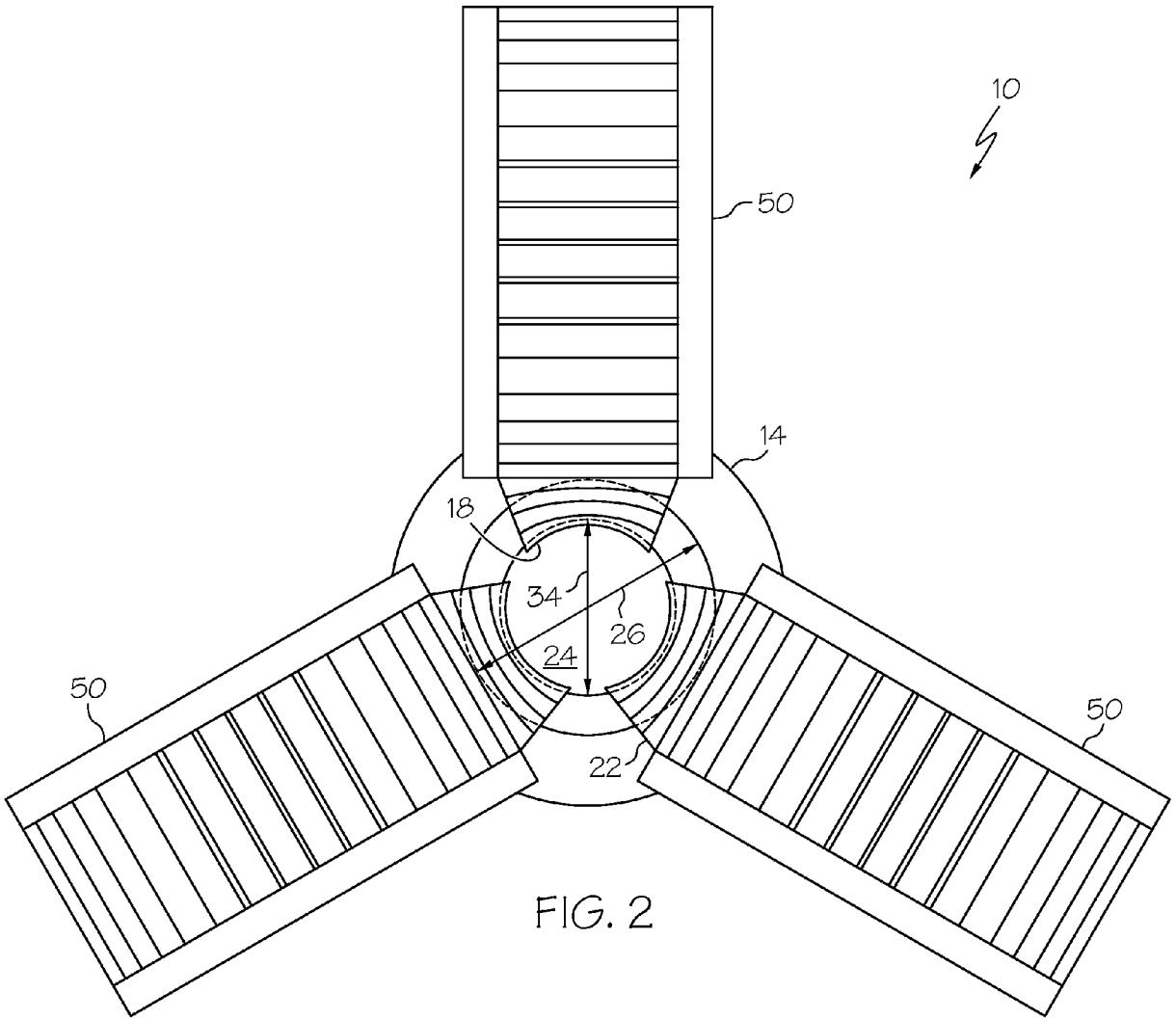
FIG. 2 depicts an end view of the permeable material compacting apparatus of FIG. 1.
Figure 3:
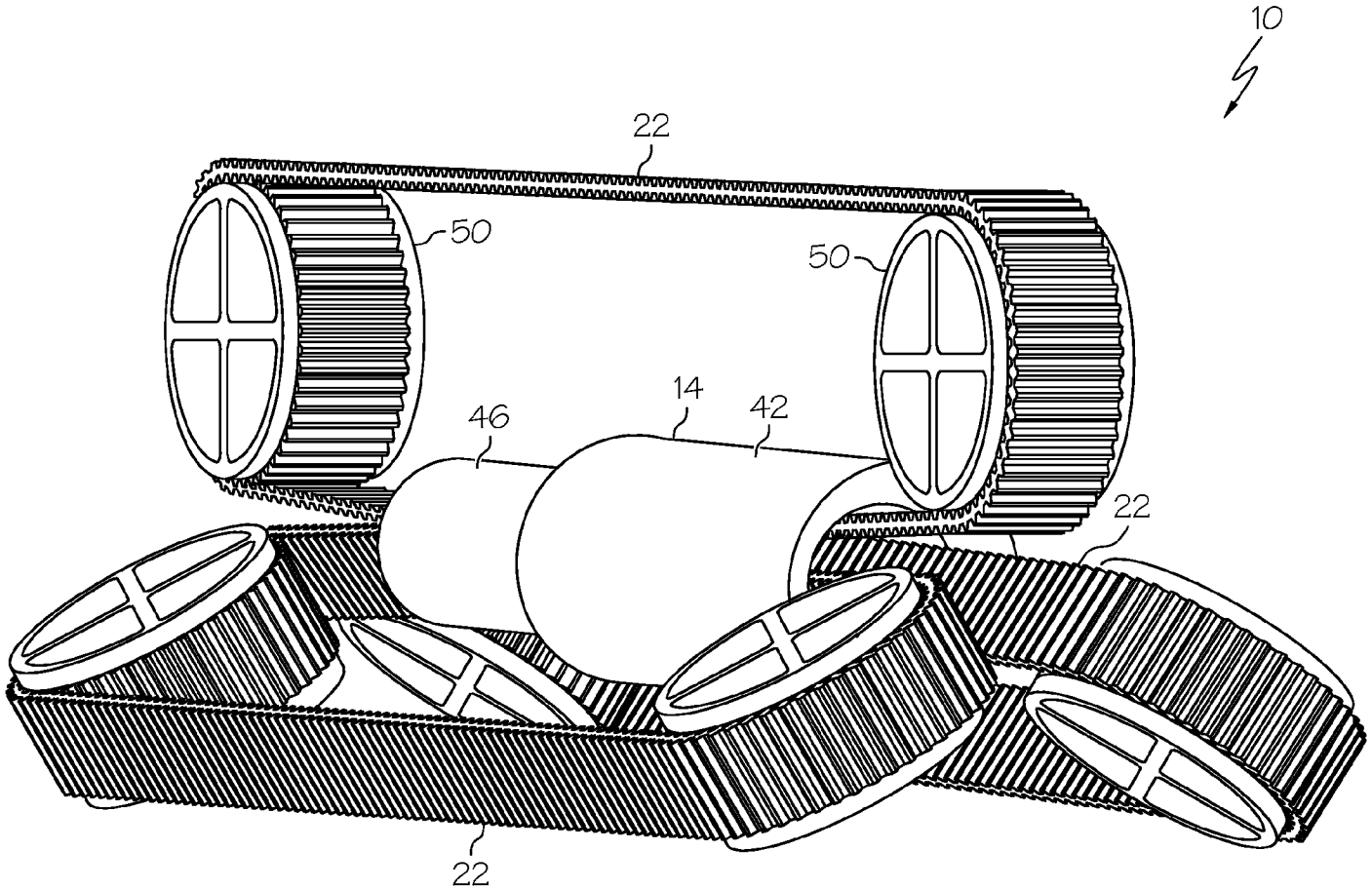
FIG. 3 depicts a semitransparent perspective view of the permeable material compacting apparatus of FIG. 1.
Figure 4:
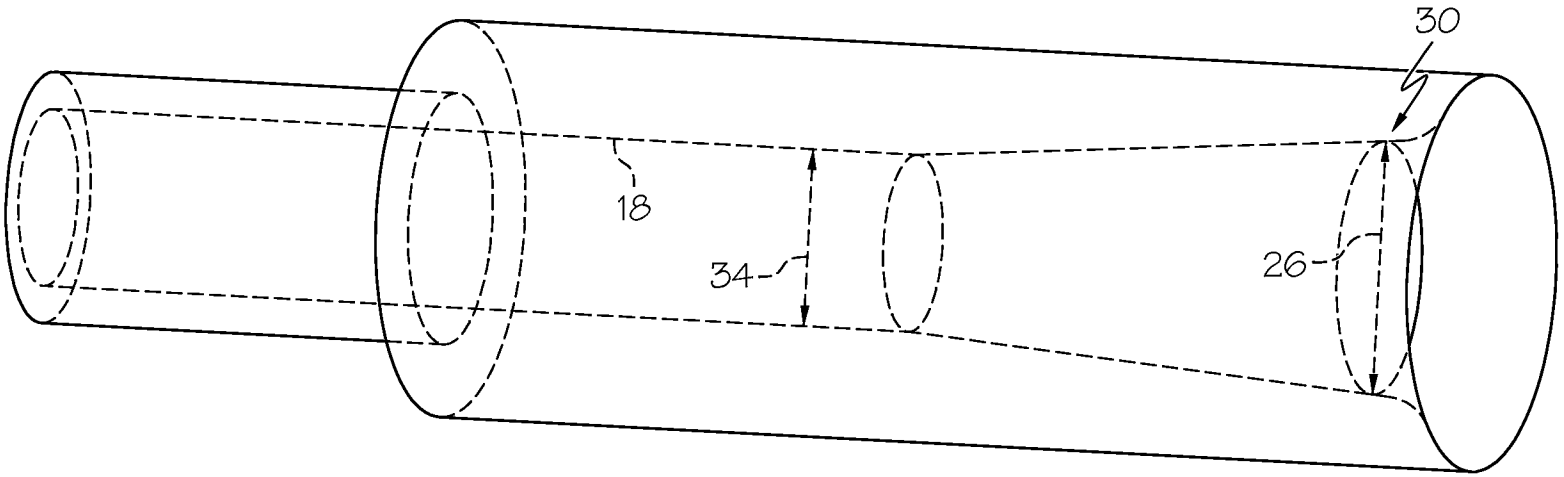
FIG. 4 depicts a semi transparent side view of the tubular of the permeable material compacting apparatus of FIG. 1.

Referring to FIGS. 1 through 4 an embodiment of a permeable material compacting apparatus disclosed herein is illustrated at 10. The permeable material compacting apparatus 10 includes, a tubular 14 having an internal surface 18 with varying radial dimensions and three elongated members 22 that are longitudinally movable through the tubular 14. The elongated members 22 are relatively thin and flexible and can deform and contour to the internal surface 18 as they slide along the internal surface 18. Although the embodiment illustrated shows three of the elongated members 22, any practical number of elongated members 22 is contemplated including a single elongated member 22.

Permeable material 23 (shown in FIG. 1 only) such as foam, for example, drawn through an interior 24 (FIG. 2) of the tubular 14 along with the elongated members 22 is radially compacted in the process. The internal surface 18 has a first dimension 26 near one end 30 of the tubular 14 and a second dimension 34 that is smaller than the first dimension 26 and is displaced longitudinally from the first dimension 26. The internal surface 18 also includes a smooth transition between the first dimension 26 and the second dimension 34. Any loft in the permeable material 23 causes the elongated members 22 to be compressed between the permeable material 23 and the internal surface 18 thereby causing the elongated members 22 to deform and conform to the shape of the internal surface 18. This conformity occurs continuously throughout the travel of the elongated members 22 through the tubular 14. As such, the permeable material 23 is compressed to a shape substantially defined by the internal surface 18 taking into account any thickness of the elongated members 22 as well as any gaps between perimetrically adjacent elongated members 22.

The internal surface 18 can have various cross-sectional shapes including, circular, oval, and polygonal, for example, for cross sections taken orthogonal to an axis of the tubular 14, with the embodiment illustrated being circular. Additionally, the internal surface 18 can have various cross-sectional profiles for cross sections taken parallel and through the axis of the tubular 14. For example the cross sectional profile can be tapered with straight lines connecting the first dimension 26 with the second dimension 34, thereby forming a frustoconical portion of the internal surface 18, as is illustrated in the embodiment herein. Or the profile can have curved lines connecting the first dimension 26 with the second dimension 34. If employing curved lines, it may be desirable to have the curved lines configured such that a radial dimension thereof continuously decreases when observed starting at the first dimension 26 and moving to the second dimension 34 so that compression of the permeable material is continuous in response to it being moved through the tubular 14. Although specific profiles are illustrated herein any profile that includes a decrease in radial dimensions between the first dimension 26 and the second dimension 34 fall within the scope of this invention. Maintaining radial dimensions from the second dimension 34 to an end 38 of the tubular 14 opposite the end 30, as illustrated, may be desirable as well for reasons elaborated on below.

The tubular 14 and the elongated members 22 can include heaters 42 and coolers 46. The heaters 42 and coolers 46 may employ any applicable mechanism suitable for generating changes in temperature at the locations desired. For example, thermoelectric materials can be employed at or near the internal surface 18 or a surface 48 of the elongated members 22 to change temperature of the surface 18, 48 in response to electrical energy applied thereto. Temperature changes in the tubular 14 and the elongated members 22 would transfer to the permeable material as it moves through the tubular 14. For example, the temperature may be elevated while the permeable material is moving between the first dimension 26 and the second dimension 34 to soften the permeable material thereby making compression thereof easier. Additionally, the temperature may be lowered while the permeable material moves between the location within the tubular 14 where the second dimension 34 is first achieved and the end 38 to essentially freeze-in the permeable material at the reduced volume, compacted configuration. In so doing the permeable material can be maintained at the compacted configuration until temperature thereof is increased again to thereby let any internal stress stored in the permeable material release to reshape the permeable material back to a larger volume configuration, perhaps to the volume the permeable material had prior to being compressed by the apparatus 10. When employed in a downhole screen application, for example, the permeable material can serve as a conformable screen that upon exposure to elevated temperatures and/or other conditions either anticipated to be encountered downhole or arranged by artifice to be downhole, can radially expand into conformable contact with walls of a formation.

The permeable materials may also include some high-loft materials, which, as initially assembled, are largely void, such as high-loft fiber mat. These materials, in order to serve their purpose downhole, must be consolidated or compacted into a more dense layer. Additionally, some materials, while held in the consolidated or compacted arrangement require that the temperature of the fiber be raised to a determined temperature. Such materials are sometimes referred to as heat fusible mats.

It should also be understood that the term permeable material as used herein covers any material that could serve as a filter to remove unwanted particulates from fluid passing therethrough. This filtration can be via flow through pores, cells or interstices, for example and as such, materials employable as the permeable material include porous or cellular materials as well as membranes, mats and foams.

Returning to the Figures, one embodiment, as illustrated herein, is for the elongated members 22 to be in the shape of a loop of material such as a belt, for example, so that the elongated material 22 cycles back through the tubular 14 over and over. Rotational elements 50, shown herein as wheels, positioned beyond one or both ends 30 and 38 can serve to guide as well as drive the elongated members 22 through the interior 24 of the tubular 14. The rotational elements 50 can have grooves 54 (FIG. 1) on a surface thereof that engage with complementary grooves 58 on the elongated members 22 to aid in transferring torque from the rotational elements 50 to the elongated members 22. Frictional engagement between the rotational elements 50 and the elongated members 22 is another employable method to provide the needed transfer of torque. The elongated members 22 through the interior 24 of the tubular 14 may have grooves 56 or other raised features, preferentially across the width of the elongated members 22 so as to form circumferentially-oriented raised features that may grip the permeable material to aid in drawing it through the tubular 14.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed:

1. A permeable material compacting method comprising:

positioning a portion of at least one elongated member within the interior of a tubular;

moving a portion of the at least one elongated member through the interior of the tubular;

moving a permeable material through the interior of the tubular with the portion of the at least one elongated member;

radially compacting the permeable material as the permeable material passes through the interior of the tubular;

moving the portion of the at least one elongated member through the interior of the tubular again; and radially compacting more of the permeable material as the permeable material passes through the interior of the tubular.

2. The permeable material compacting method of claim 1, further comprising deforming the portion of the at least one elongated member as the at least one portion passes through the interior of the tubular.

3. The permeable material compacting method of claim 1, further comprising conforming the portion of the at least one elongated member to an interior surface of the tubular.

4. The permeable material compacting method of claim 1, further comprising heating the permeable material as the permeable material passes through the interior of the tubular.

5. The permeable material compacting method of claim 1, further comprising cooling the permeable material as the permeable material passes through the interior of the tubular.

6. A permeable material compacting apparatus comprising:

a tubular having an internal surface with varying radial dimensions; and at least one elongated member being repeatedly movable through the interior of the tubular configured to conform to the internal surface such that permeable material moved through the interior of the tubular with the at least one elongated member is compacted.

7. The permeable material compacting apparatus of claim 6, wherein the at least one elongated member is a belt.

8. The permeable material compacting apparatus of claim 6, wherein the at least one elongated member is three elongated members.

9. The permeable material compacting apparatus of claim 6, further comprising at least one rotational element in operable communication with the at least one elongated member configured to urge the at least one elongated member longitudinally through the interior of the tubular in response to rotation thereof.

10. The permeable material compacting apparatus of claim 6, wherein the at least one elongated member forms a loop.

11. The permeable material compacting apparatus of claim 6, wherein the varying radial dimension tapers from a larger to a smaller radial dimension from at least one end toward the other.

12. The permeable material compacting apparatus of claim 6, wherein at least a portion of the internal surface is frustoconical.

13. The permeable material compacting apparatus of claim 6, further comprising a heater in operable communication with at least one of the tubular and the at least one elongated member.

14. The permeable material compacting apparatus of claim 6, further comprising a cooler in operable communication with at least one of the tubular and the at least one elongated member.

15. The permeable material compacting apparatus of claim 6, wherein the internal surface and thickness of the at least one elongated member determine final radial dimensions of the permeable material.

16. The permeable material compacting apparatus of claim 6, wherein the permeable material is from the group consisting of foam, membrane, porous material, cellular material and heat fusible mat.

17. The permeable material compacting apparatus of claim 6, wherein the permeable material is a downhole conformable screen.

* * * * *